US005790140A

United States Patent [19]

Koizumi et al.

[11] Patent Number: 5,790,140

[45] Date of Patent: Aug. 4, 1998

[54] PRINTING HEAD, AND PRINTER AND PRINTING METHOD USING THE PRINTING HEAD

[75] Inventors: Ryoichi Koizumi, Yokohama; Masahiko Ogawa, Hino, both of Japan

[73] Assignee: Canon Kabushiki Kaisha, Tokyo, Japan

[21] Appl. No.: 424,961

[22] Filed: Apr. 19, 1995

[30] Foreign Application Priority Data

Apr. 22, 1994 [JP] Japan ..... 6-085103

[51] Int. Cl.[6] ..... B41J 29/38

[52] U.S. Cl. ..... 347/12; 347/42

[58] Field of Search ..... 347/12, 13, 42, 347/180, 181, 182

[56] References Cited

U.S. PATENT DOCUMENTS

| | | | |
|---|---|---|---|
| 3,925,790 | 12/1975 | Fishbeck | 346/140 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,043,748 | 8/1991 | Katayama et al. . | |
| 5,305,024 | 4/1994 | Moriguchi et al. | 346/140 R |
| 5,353,043 | 10/1994 | Akiyama | 346/76 |
| 5,357,268 | 10/1994 | Kishida et al. | 347/13 |
| 5,412,406 | 5/1995 | Fujimoto | 347/180 |
| 5,477,245 | 12/1995 | Fuse | 347/10 |
| 5,486,848 | 1/1996 | Ayata et al. | 347/15 |
| 5,528,275 | 6/1996 | Shiya et al. | 347/183 |
| 5,548,688 | 8/1996 | Wiklof et al. | 395/108 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

A printing head according to the present invention resets the count value of a counter in response to an externally supplied signal, and thereafter, counts a signal supplied upon input of an image signal. A decoder generates a selection signal in accordance with the count value, thereby selecting a divided heat-generating element group in units of 32 clocks. Furthermore, an electric current is supplied to heat-generating resistors which belong to the selected heat-generating element group, thereby performing a printing operation. With this printing head, a printer, which can be controlled by a smaller number of control signals, can be realized.

29 Claims, 12 Drawing Sheets

PRINTING HEAD, AND PRINTER AND PRINTING METHOD USING THE PRINTING HEAD

BACKGROUND OF THE INVENTION

This invention relates to a printing head, and a printer and printing method using the printing head and, more particularly, to a printer which performs printing by forming droplets and discharging the droplets onto a printing medium, and especially uses a printing head which performs printing by giving a thermal effect to a liquid to boil the liquid so as to form droplets, and discharging the droplets onto a printing medium, and a printing method using the printing head.

Conventionally, various kinds of printers which have printing heads each comprising an array of a plurality of printing elements so as to perform printing on printing media are known. The printing head of such a printer normally has an arrangement in which a plurality of printing elements, and a driving integrated circuit which can concurrently drive a predetermined number of printing elements as one block are mounted on a single board. With this arrangement, by arranging image data in correspondence with the printing elements, a desired printing operation can be achieved on a printing medium (a paper sheet, cloth, plastic sheet, or the like).

Of these printers, an ink-jet printer, which performs low-noise and non-impact printing by discharging an ink from discharge nozzles arranged on printing elements, can achieve high-density, high-speed printing. For this reason, the ink-jet printer is utilized in information processing systems as printers serving as output terminals of a copying machine, facsimile apparatus, printer, word processor, work station, and the like, or as a handy or portable printer equipped in a personal computer, host computer, optical disk apparatus, video apparatus, and the like, and is commercially available.

Such a printer comprises printing means (printing head), transfer means for transferring a printing medium, driving means for reciprocally scanning the printing head in a direction perpendicular to the transfer direction of the printing medium, and control means for controlling ink discharge from the printing head, and the transfer and driving means. The apparatus employs a printing method for serially scanning the printing head for discharging ink droplets from a plurality of discharge nozzles in the direction (main scanning direction) perpendicular to the transfer direction of the printing medium, and intermittently transferring the printing medium by a transfer amount equal to the printing width upon printing. This printing method achieves printing by discharging an ink onto a printing medium in accordance with a printing signal, and is popularly used as a low-noise printing method with low running cost. When a head on which a large number of nozzles for discharging an ink are formed on a line perpendicular to the moving direction of the printing head is used, printing can be achieved with a width corresponding to the number of nozzles each time the printing head scans the printing medium, thus attaining high-speed printing.

In the printing head, function elements (e.g., transistors) each for sending an electric current to each printing element are arranged in correspondence with the plurality of printing elements, and a logic circuit for drive-controlling these function elements and the function elements are integrated in the same board.

FIG. 9 is a block diagram showing the circuit arrangement of a conventional printing head having a 128-bit printing element, which can perform printing for 128 pixels (one pixel corresponds to 1 bit) in the transfer direction of a printing medium in a single printing operation. Referring to FIG. 9, reference numeral 31 denotes a 128-bit shift register; 32, a 128-bit latch; 33, a 128-bit transistor array for driving a heat-generating element group; 34, a heat-generating element group including 128 heat-generating resistors (R1 to R128); and 35, a gate circuit including 128 AND gates. Reference symbol $V_H$ denotes an applied voltage to be applied to the heat-generating element group 34. Signals to be input to the printing head include signals LAT (data latch signal), DATA (image signal for 128 pixels), and CLK (clock signal) as image-related signals, and signals STRB (strobe signal), HEATA, HEATB, HEATC, and HEATD as driving-related signals. A total of 128 bits are divided into four blocks, i.e., blocks A to D in units of 32 bits.

FIG. 10 is a timing chart showing the driving sequence of the printing head shown in FIG. 9. Reference symbols denoting various signals shown in FIG. 10 correspond to those used in FIG. 9. Four blocks (A to D) are respectively selected by four signals HEATA, HEATB, HEATC, and HEATD, and when each block is selected, a corresponding selected signal HEATX (x=A, B, C, D) is enabled.

FIG. 11 is a block diagram showing the circuit arrangement of a conventional printing head having a 64-bit printing element group, which can perform printing for 64 pixels (1 pixel corresponds to 1 bit) in the transfer direction of a printing medium in a single printing operation. Referring to FIG. 11, reference numeral 41 denotes a 64-bit shift register; 42, a 64-bit latch; 43, a 64-bit transistor array; 44, a heat-generating element group including 64 heat-generating resistors (R1 to R64); 45, a gate circuit including 64 AND gates; and 46, a block selection circuit for selecting one of eight blocks to be described below. Reference symbol RESET denotes a reset signal; and BLOCKENB1, BLOCKENB2, and BLOCKENB3, signals for indicating one to be enabled of the eight blocks. Other signals are the same as those in FIG. 9.

FIG. 12 is a timing chart showing the driving sequence of the printing head shown in FIG. 11. Reference symbols denoting various signals shown in FIG. 12 correspond to those used in FIG. 11. The arrangement shown in FIG. 11 is substantially the same as that shown in FIG. 9, except for the number of pixels printed in the transfer direction of the printing medium. In the case of the printing head with the arrangement shown in FIG. 11, the 64 heat-generating resistors (R1 to R64) are divided into eight blocks, and these blocks are driven by different signals (B1 to B8).

As described above, the arrangement shown in FIG. 11 also comprises shift registers and latches corresponding in number to the heat-generating elements on a single board so as to drive the plurality of heat-generating resistors. In addition, the entire printing head is controlled using a latch signal and a plurality of enable signals (BLOCKENB1 to BLOCKENB3) independent from other control signals.

In the prior arts, as the number of divided blocks becomes larger, the number of selection signals becomes larger. As a result, the printing head undesirably has a large size, and the thickness of a flexible print board for supplying signals to the head increases in proportion to the number of signals, thus increasing cost. Furthermore, an increase in the number of signal lines, i.e., an increase in the number of line connections causes low reliability of the apparatus.

For example, in the case of the printing head with the arrangement shown in FIG. 9, the four signals HEATA, HEATB, HEATC, and HEATD must be supplied from a circuit outside the printing head as signals for selecting the heat-generating elements divided into groups. On the other hand, in the case of the printing head with the arrangement shown in FIG. 11, a plurality of enable signals (BLOCKENB1 to BLOCKENB3) must also be supplied from a circuit outside the printing head as signals for selecting the heat-generating resistors divided into groups.

In order to solve the above-mentioned problems, a method of inputting data and clock signals for selecting a block using an integrated decoder or flip-flop circuit for block selection in the printing head has been proposed.

In consideration of recent tendency for compact printers, size reduction and cost reduction of the apparatus by reducing the number of input signals for the printing head are desirable.

When the number of heat-generating resistors is increased to increase the number of pixels printed in the transfer direction of a printing medium in a single scan operation, the board area increases, and the yield in the manufacture of boards abruptly deteriorates, resulting in high manufacturing cost. In this respect as well, it is desirable to simplify the circuit arrangement to be integrated in the printing head as much as possible so as to reduce the board area.

SUMMARY OF THE INVENTION

Accordingly, it is an object of the present invention to provide a highly reliable, compact printing head which can contribute to cost reduction.

According to one aspect of the present invention, the foregoing object is attained by providing a printing head, in which a plurality of printing elements are divided into a plurality of groups, including the plurality of transducers for driving the plurality of printing elements in each group unit, sending an electric current to each divided group of the plurality of transducers in accordance with printing data, comprising: counter means for counting an input clock signal; instruction signal generation means for generating an instruction signal which instructs to drive the printing elements corresponding to one of the plurality of divided groups on the basis of a count value output from said counter means; latch means for latching printing data for a predetermined number of pixels; and electric current sending means for sending the electric current to the transducers corresponding to one of the plurality of divided groups in accordance with the printing data latched by the latch means, and the instruction signal.

It is another object of the present invention to provide a printer which uses a compact, inexpensive and highly reliable printing head.

According to another aspect of the present invention, the foregoing object is attained by providing a printer for printing an image on a printing medium by electrically driving the above-mentioned printing head, comprising: input means for inputting image data from an external unit; storage means for temporarily storing the image data input by the input means; transmission means for transmitting printing data and a clock signal in accordance with the image data stored in the storage means; first supply means for supplying a strobe signal for supplying an electric current to the printing head and driving the transducers of the printing head, to the printing head at a predetermined interval; and second supply means for supplying a reset signal to reset a count value of the counter means, included in the printing head, for counting the clock signal.

It is still another object of the present invention to provide a printing method using a compact, inexpensive and highly reliable printing head.

According to a further aspect of the present invention, the foregoing object is attained by providing a printing method of printing an image on a printing medium by electrically driving the above-mentioned printing head, comprising: an input step of inputting image data from an external unit; a storage step of temporarily storing the image data input in the input step in a storage medium; a reset step of supplying a reset signal to reset a count value of the counter means, included in the printing head, for counting the transmission clock; a transmission step of transmitting printing data and a clock for the image signal in accordance with the image data stored in the storage medium; and a supply step of supplying a strobe signal for supplying an electric current to the printing head and driving the electrothermal transducers of the printing head, to the printing head at a predetermined interval.

In accordance with the present invention as described above, the printing head generates an instruction signal for instructing driving of the printing elements corresponding to one of the plurality of groups on the basis of a count value obtained by counting input clock signals, and latches an input image signal for a predetermined number of pixels. The printing head sends an electric current to the electrothermal transducers corresponding to one of the plurality of groups in accordance with the latched image signal and the instruction signal.

In accordance with yet another aspect of the present invention, image data is input from an external device, and the input image data is temporarily stored. An image signal and transmission clocks of the image signal are transmitted to the printing head in accordance with the stored image data, and strobe signals for sending an electrical current to the electrothermal transducers of the printing head to drive them are supplied to the printing head at predetermined intervals. In addition, a reset signal is supplied to reset the count value of the counter means, included in the printing head, for counting the number of transmission clocks.

In accordance with still another aspect of the present invention, image data is input from an external device, and the input image data is temporarily stored in a storage medium. A reset signal is supplied to reset the count value of the counter, included in the printing head, for counting the number of clocks, and an image signal and transmission clocks of the image signal are transmitted to the printing head in accordance with the image data stored in the storage medium. In addition, strobe signals for sending an electrical current to the electrothermal transducers of the printing head to drive them are supplied to the printing head at predetermined intervals.

The invention is particularly advantageous since the printing operation and control of the printing head can be realized while the number of signals to be supplied to the printing head is reduced, and signals required for controlling the printing head are generated by a simple internal circuit of the printing head on the basis of supplied signals. With this arrangement, since the number of signal lines for connecting an external device for supplying signals to the printing head, and the printing head can be reduced, the number of signal input terminals provided to the printing head can be reduced, thus contributing to size reduction and cost reduction of the printing head.

Also, the decrease in the number of supplied signals leads to an improvement in reliability of the apparatus.

In accordance with another aspect of the present invention, since the printing head can be controlled by a smaller number of signal lines, the control operation in the printer which incorporates the printing head can be simplified. Thus, since the number of signal lines for connecting the printer and the printing head can also be reduced, an improvement in reliability of the apparatus and cost reduction can be realized.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

The arrangement of a printer as an apparatus of an embodiment common to some embodiments to be described below will be explained first.

<Brief Description of Apparatus Main Unit (FIG. 1)>

Figure 1:
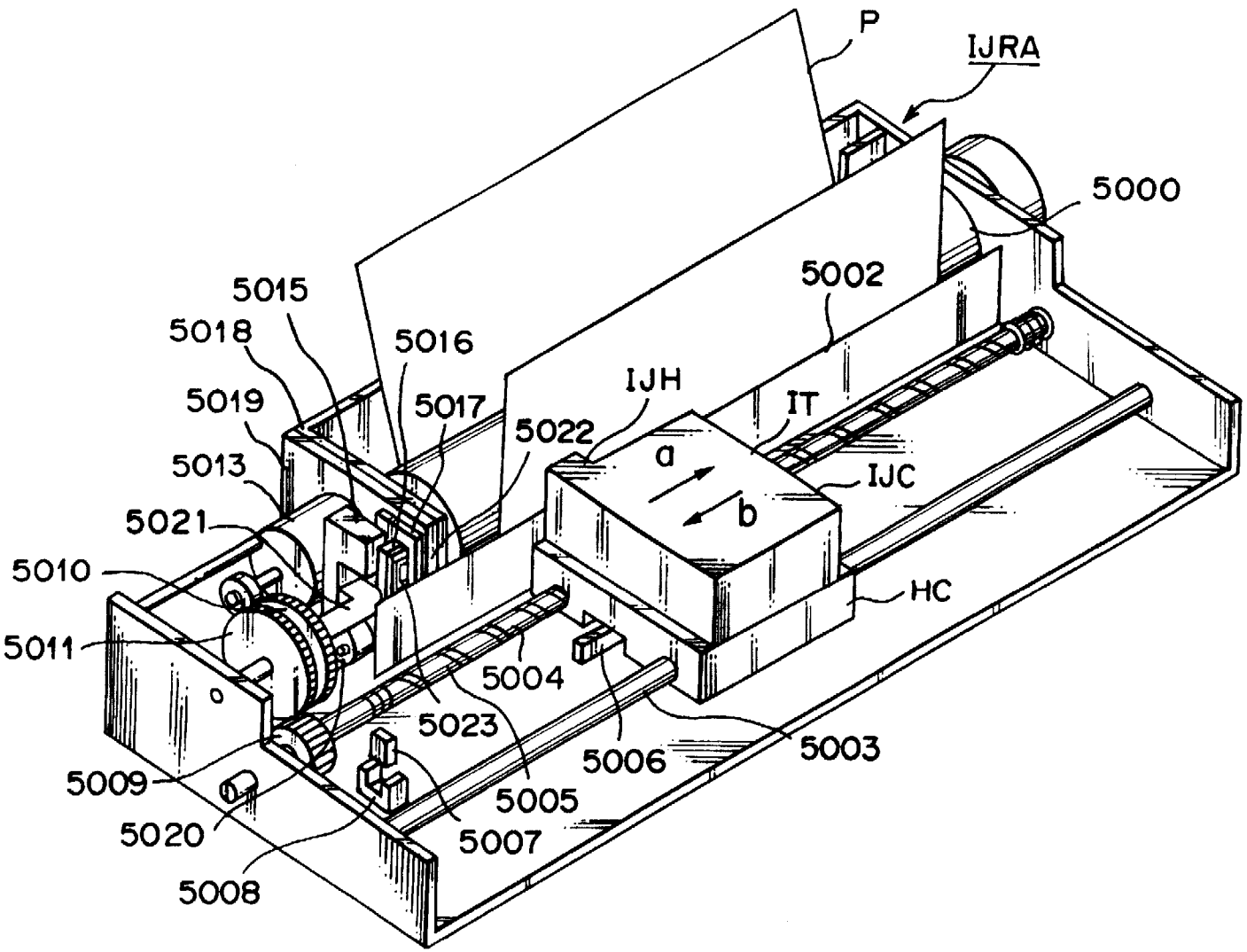
FIG. 1 is a perspective view showing the outer appearance of an ink-jet printer IJRA as a typical embodiment of the present invention.

FIG. 1 is a perspective view showing the outer appearance of an ink-jet printer IJRA as a typical embodiment of the present invention. Referring to FIG. 1, a carriage HC engages with a spiral groove 5005 of a lead screw 5004, which rotates via driving force transmission gears 5009 to 5011 upon forward/reverse rotation of a driving motor 5013. The carriage HC has a pin (not shown), and is reciprocally scanned in the directions of arrows a and b in FIG. 1. An integrated ink-jet cartridge IJC which incorporates a printing head IJH and an ink tank IT is mounted on the carriage HC. Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timings.

<Description of Control Arrangement (FIG. 2)>

The control arrangement for executing the printing control of the above-mentioned apparatus will be explained below.

Figure 2:
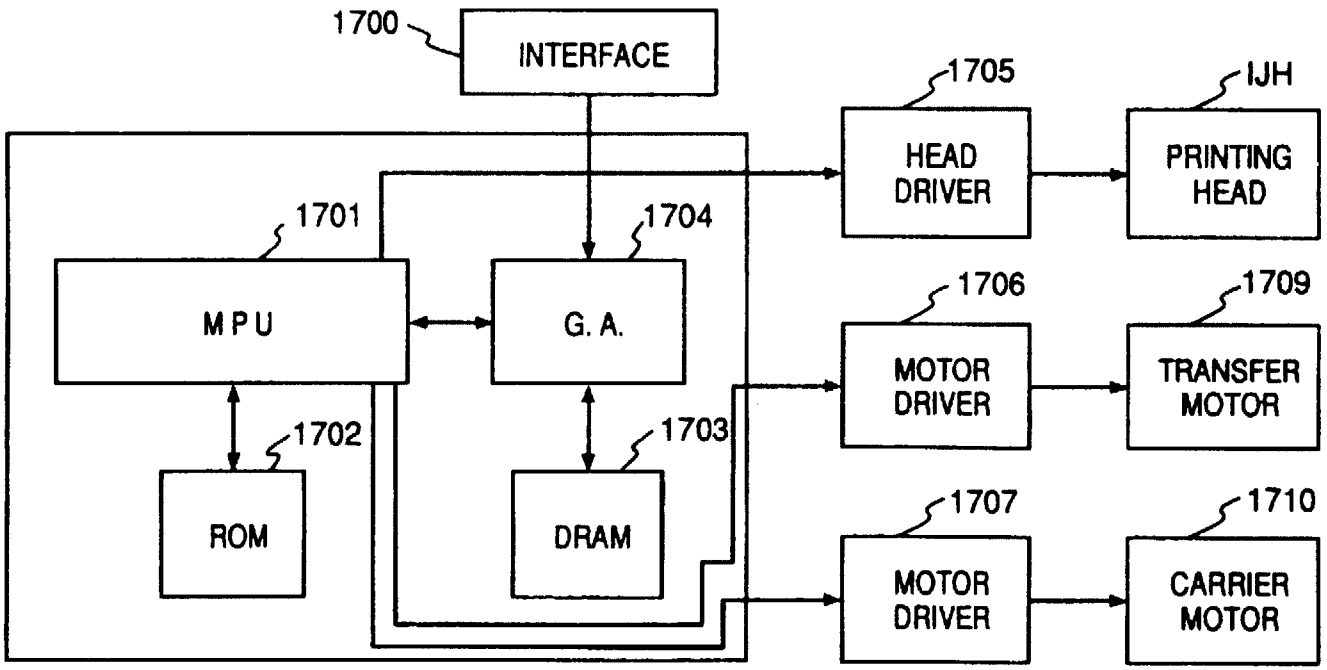
FIG. 2 is a block diagram showing the arrangement of a control circuit of the ink-jet printer IJRA.

FIG. 2 is a block diagram showing the arrangement of a control circuit of the ink-jet printer IJRA. Referring to FIG. 2 showing the control circuit, reference numeral 1700 denotes an interface for inputting a printing signal (image signal) from an external device; 1701, an MPU; 1702, a ROM for storing a control program executed by the MPU 1701; and 1703, a DRAM for storing various data (the printing signal, printing data supplied to the printing head, and the like). Reference numeral 1704 denotes a gate array (G.A.) for performing supply control of printing data to the printing head IJH. The gate array 1704 also performs data transfer control among the interface 1700, the MPU 1701, and the RAM 1703. Reference numeral 1710 denotes a carrier motor for transferring the printing head IJH; and 1709, a transfer motor for transferring a printing sheet. Reference numeral 1705 denotes a head driver for driving a head; and 1706 and 1707, motor drivers for driving the transfer motor 1709 and the carrier motor 1710.

The operation of the above control arrangement will be described below. When a printing signal is input to the interface 1700, the printing signal is converted into printing data for a printing operation between the gate array 1704 and the MPU 1701. The motor drivers 1706 and 1707 are driven, and the printing head IJH is driven in accordance with the printing data supplied to the head driver 1705, thus performing the printing operation.

In the embodiments to be described below, four signal lines (not shown) are supplied from the head driver 1705 to the printing head IJH, and the printing head IJH is driven by the following four signals ((1) image signal (DATA), (2) clock signal (CLK), (3) reset signal (RESET), (4) strobe signal (STRB)) supplied via these signal lines, and an applied voltage $V_H$ to the printing head. The supply timings of these signals to the printing head IJH are controlled by the MPU 1701.

[First Embodiment]

Figure 3:
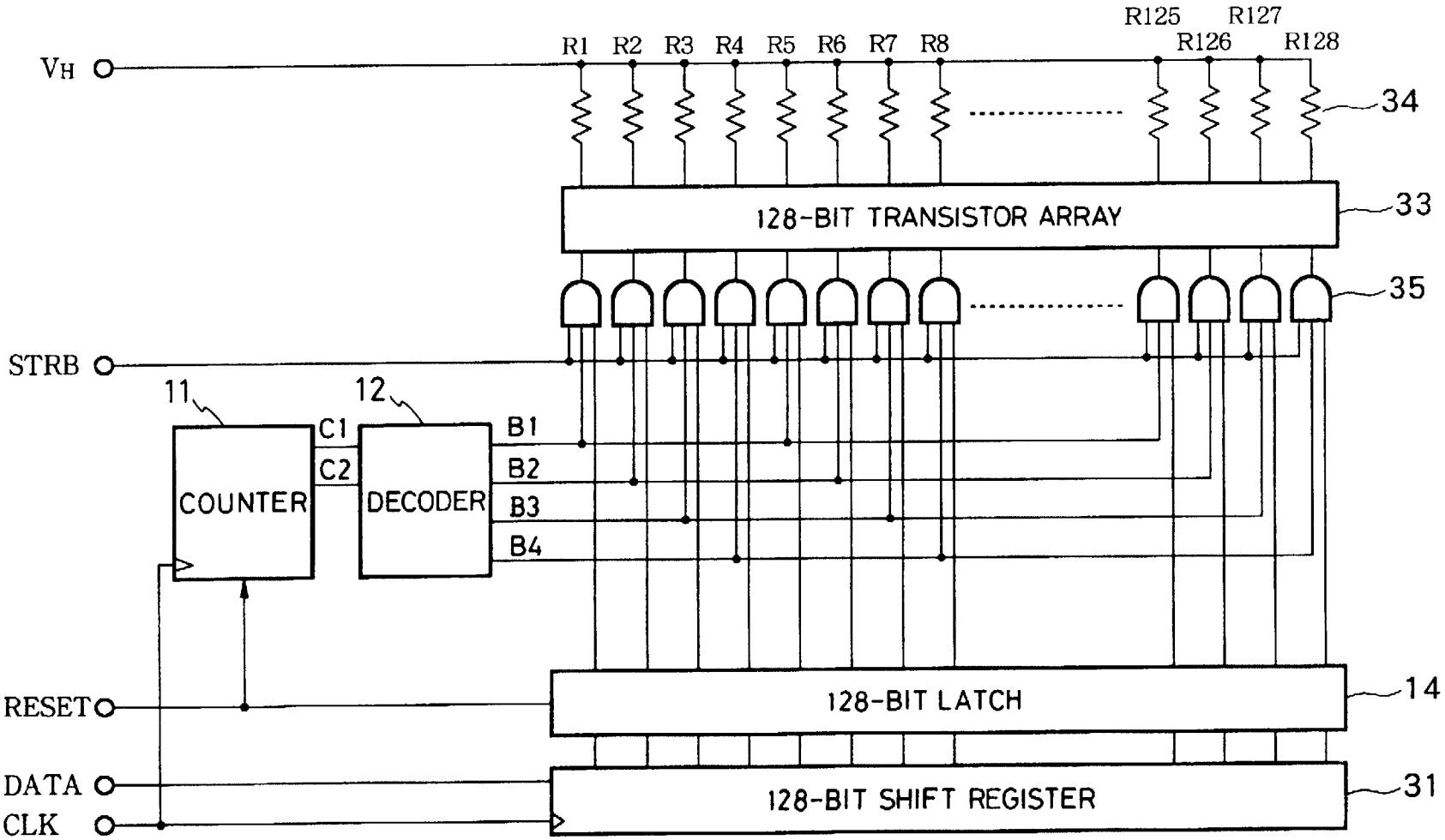
FIG. 3 is a block diagram showing the circuit arrangement of a printing head according to a first embodiment.
Figure 7:
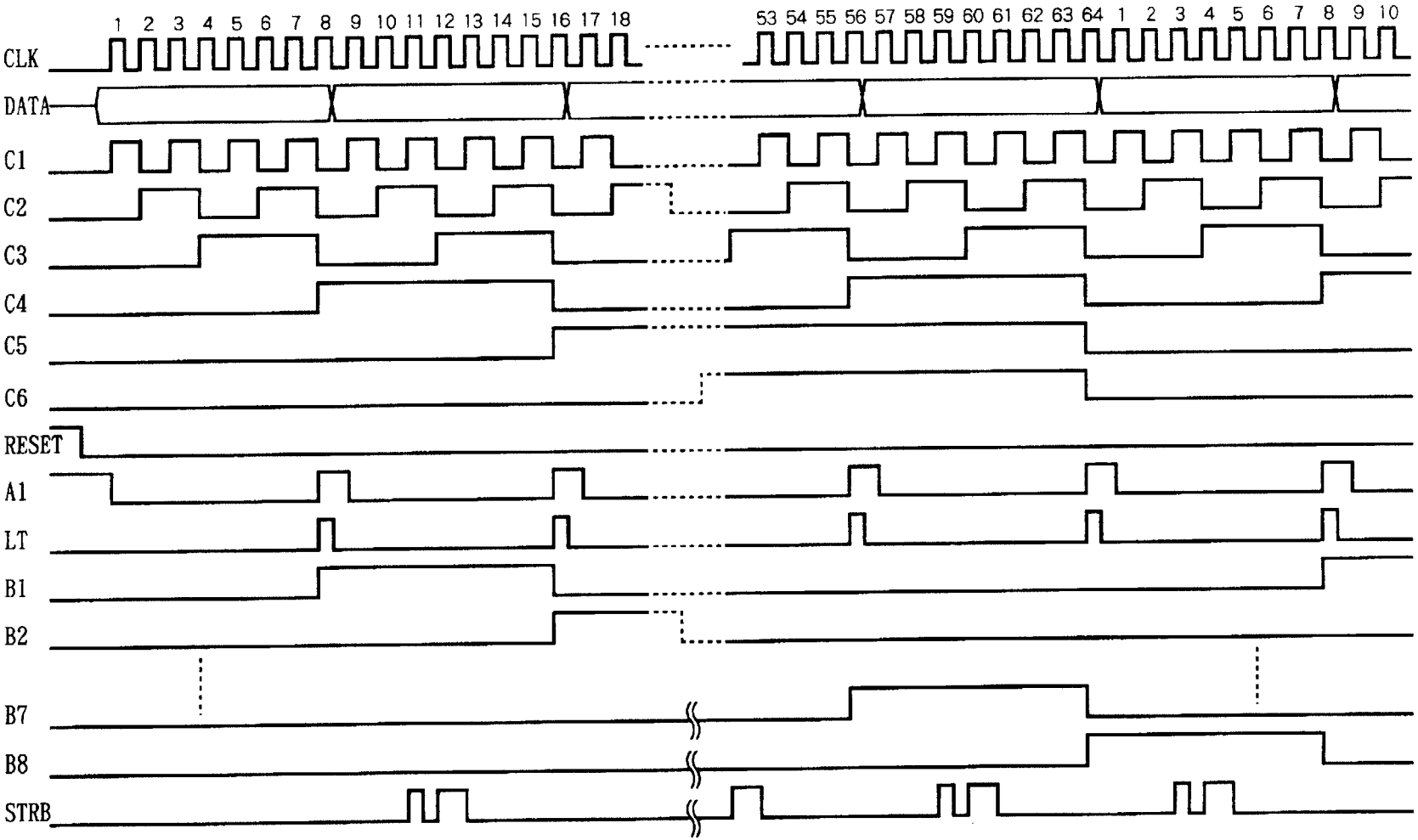
FIG. 7 is a timing chart showing various signals input to the printing head shown in FIG. 5.

FIG. 3 is a block diagram showing the circuit arrangement of the printing head IJH according to this embodiment. This circuit is arranged on a single circuit board, and this printing head can perform a printing operation for 128 pixels in the transfer direction of a printing medium in a single printing operation. Note that the same reference numerals in FIG. 3 denote the same parts as in FIG. 7 showing the conventional art, and a detailed description thereof will be omitted. Referring to FIG. 3, input signals associated with an image signal include signals CLK (clock), DATA, and RESET, and a signal STRB is a strobe signal. Reference symbol VH denotes an applied voltage to be applied to a heat-generating element group 34. The signal DATA is an image signal in units of bits, and is input in synchronism with the signal CLK. Reference numeral 11 denotes a counter for counting the signal CLK; 12, a decoder for receiving and decoding output signals C1 and C2 from the counter 11; and 14, a 128-bit latch circuit for latching an output value from a shift register 31 at the timing of the signal RESET.

Although not shown, 128 nozzles for discharging an ink supplied from an ink cartridge onto a printing medium are arranged on the heat-generating element group 34.

Figure 4:
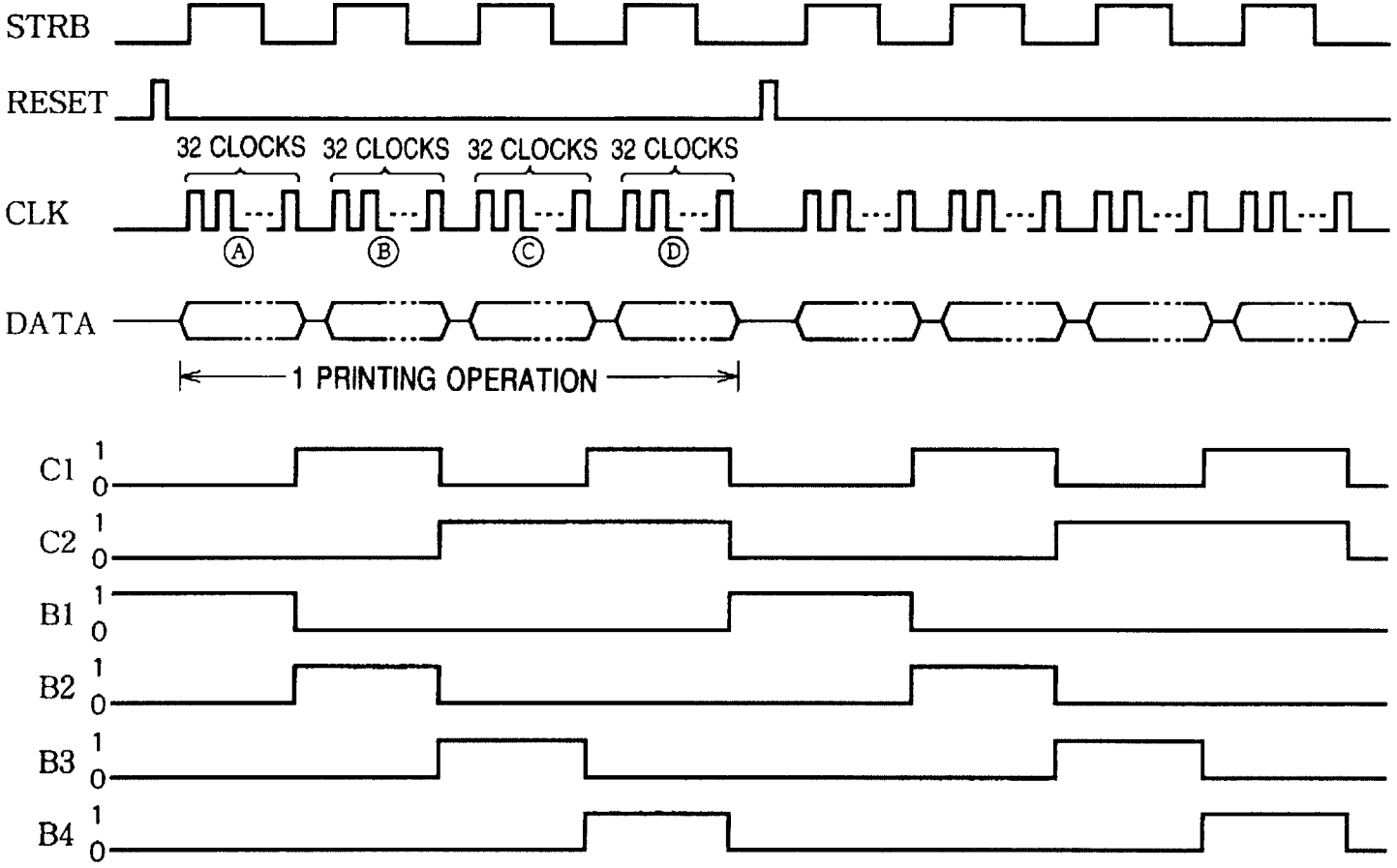
FIG. 4 is a timing chart showing various signals input to the printing head shown in FIG. 3.

FIG. 4 is a timing chart showing various signals input to the printing head IJH shown in FIG. 3. As shown in FIG. 4, the total number of clocks of the signal CLK is 128 during a single printing operation, which is equal to the number of heat-generating elements. The 128 clocks are divided into four groups (A), (B), (C), and (D) in units of 32 clocks.

During the 32 clocks of the first group (A), as shown in FIG. 4, the outputs C1 and C2 from the counter 11 respectively become "0" and "0". Therefore, the decoder 12 receives C1=0 and C2=0, and outputs (B1, B2, B3, B4) from the decoder 12 at that time become B1=1, B2=0, B3=0, and B4=0. More specifically, only the output B1 becomes "1", and heat-generating resistors R1, R5, R9, R13, . . . , R125 controlled by the output B1 are selected.

During an interval from the end of the 32 clocks of the first group (A) to the end of the 32 clocks of the next group (B), the outputs (C1, C2) of the counter 11 become C1=1 and C2=0. Therefore, the decoder 12 receives C1=1 and C2=0, and the outputs (B1, B2, B3, B4) from the decoder 12 become B1=0, B2=1, B3=0, and B4=0. More specifically, only the output B2 becomes "1", and heat-generating resistors R2, R6, R10, . . . , R126 controlled by the output B2 are selected.

During an interval from the end of the 32 clocks of the group (B) to the end of the 32 clocks of the group (C), the outputs (C1, C2) of the counter 11 become C1=0 and C2=1. Therefore, the decoder 12 receives C1=0 and C2=1, and the outputs (B1, B2, B3, B4) from the decoder 12 become B1=0, B2=0, B3=1, and B4=0. More specifically, only the output B3 becomes "1", and heat-generating resistors R3, R7, R111, . . . , R127 controlled by the output B3 are selected.

Similarly, during an interval from the end of the 32 clocks of the group (C) to the end of the 32 clocks of the group (D), only the output B4 of the decoder 12 is enabled, and heat-generating resistors R4, R8, R12, . . . , R128 are selected.

In this manner, the signal CLK is controlled by the combination of the counter 11 and the decoder 12, and block selection signals (B1, B2, B3, B4) can be generated.

On the other hand, the signal RESET is used as an input to the 128-bit latch circuit 14, and is also used as a reset signal of the counter 11.

Figure 5:
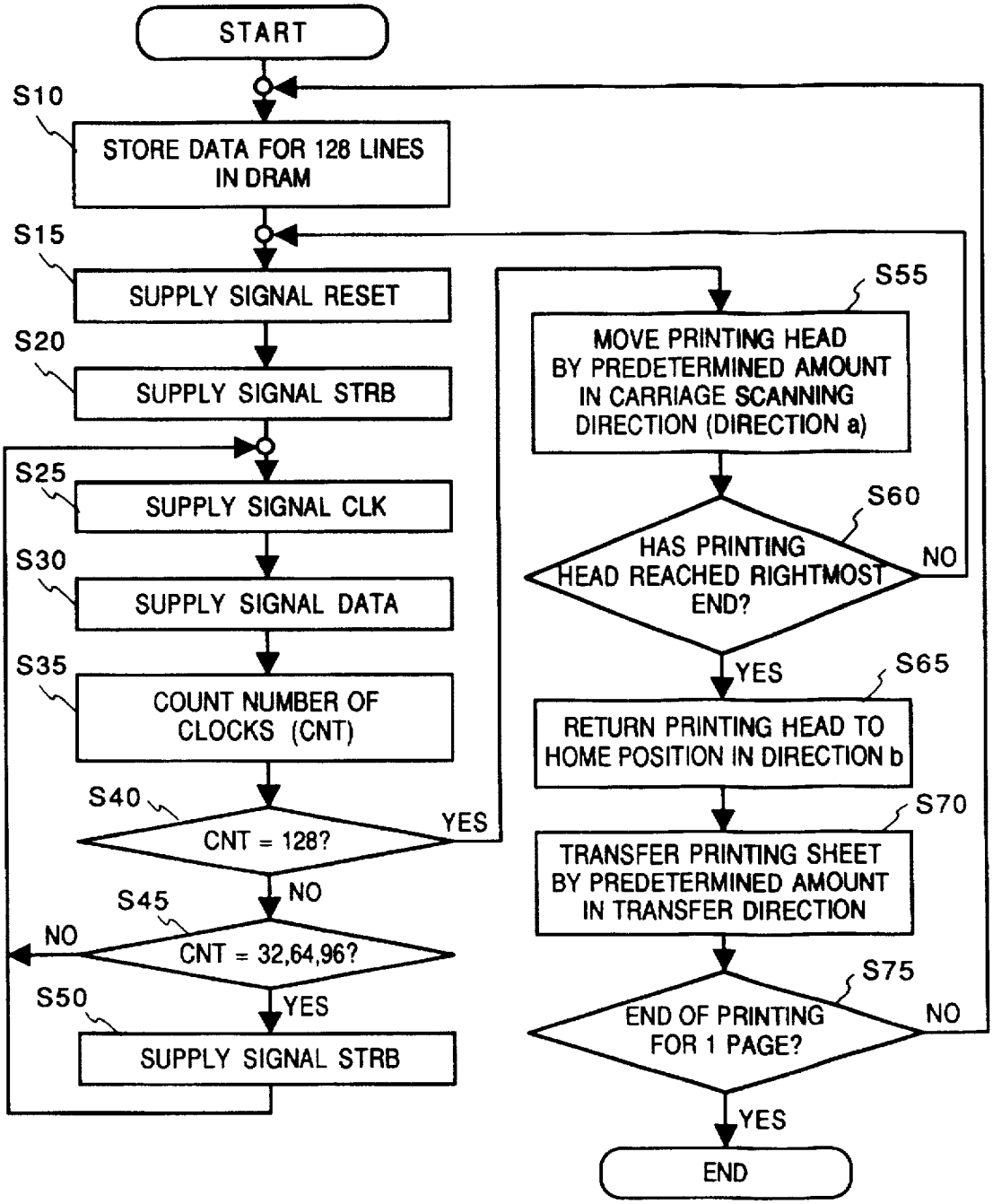
FIG. 5 is a flow chart showing the printing operation of a printer with the printing head shown in FIG. 3.

The printing operation of the printer IJRA with the printing head of this embodiment will be described below with reference to the flow chart in FIG. 5. Since the printing head of this embodiment can perform a printing operation for 128 pixels in the transfer direction of a printing medium in a single printing operation, the DRAM 1703 in a control unit stores image data for 128 lines accordingly.

In step S10, the DRAM 1703 stores image data for 128 lines. This operation is attained when an information processing apparatus (not shown) such as a work station for supplying data to the printer transmits a predetermined command and its associated data. In step S15, the count value of the counter 11 is reset, and the signal RESET is supplied to the printing head IJH to latch data from the 128-bit shift register 31 by the 128-bit latch circuit 14. In step S20, the signal STRE having a predetermined period is supplied to the printing head IJH. This period is determined by the MPU 1701 in consideration of the characteristics of the constituting elements of the apparatus such as the moving speed of the printing head in the carriage scanning direction, the heat-generation characteristics of the heat-generating element group 34, and the like.

In steps S25 and S30, the signals CLK and DATA are supplied to the printing head IJH. In step S35, the number (CNT) of clocks of the signal CLK is counted. In step S40, it is checked if the value CNT is "128". If YES in step S40, the flow advances to step S55; otherwise, the flow advances to step S45. In step S45, it is checked if the value CNT is "32, "64", or "96". If the value CNT is one of the above-mentioned three values, the flow advances to step S50, and a signal STRB having the predetermined period is supplied to the printing head IJH. On the other hand, if the value CNT is none of the three values, the flow returns to step S25.

In step S55, the printing head is moved by a predetermined amount in the carriage scanning direction (the direction of the arrow a in FIG. 1). In step S60, it is checked if the printing head has reached the rightmost end of the carriage scanning path. If NO in step S60, the flow returns to step S15. However, if YES in step S60, the flow advances to step S65, and the printing head is returned to its home position in the direction of the arrow b in FIG. 1.

In step S70, a printing medium (printing sheet) is transferred by a predetermined amount in the transfer direction. Furthermore, it is checked in step S75 if a printing operation for one page is completed. If NO in step S75, the flow returns to step S10, and the DRAM 1703 receives and stores image data for next 128 lines, thus repeating the above-mentioned processing. However, if YES in step S75, the processing ends.

Figure 9:
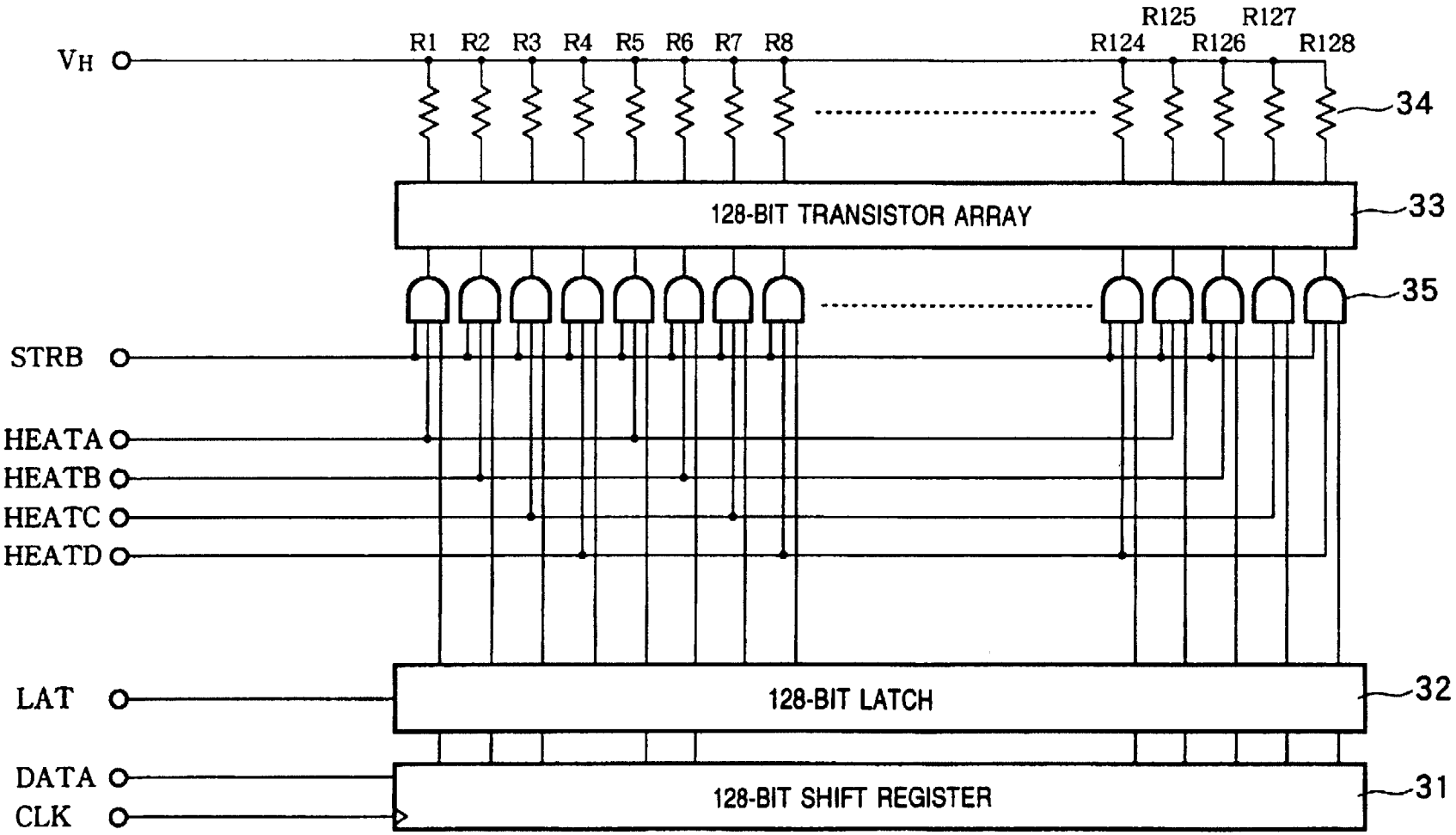
FIG. 9 PRIOR ART
FIG. 9 is a block diagram showing the circuit arrangement of a conventional printing head.
Figure 10:
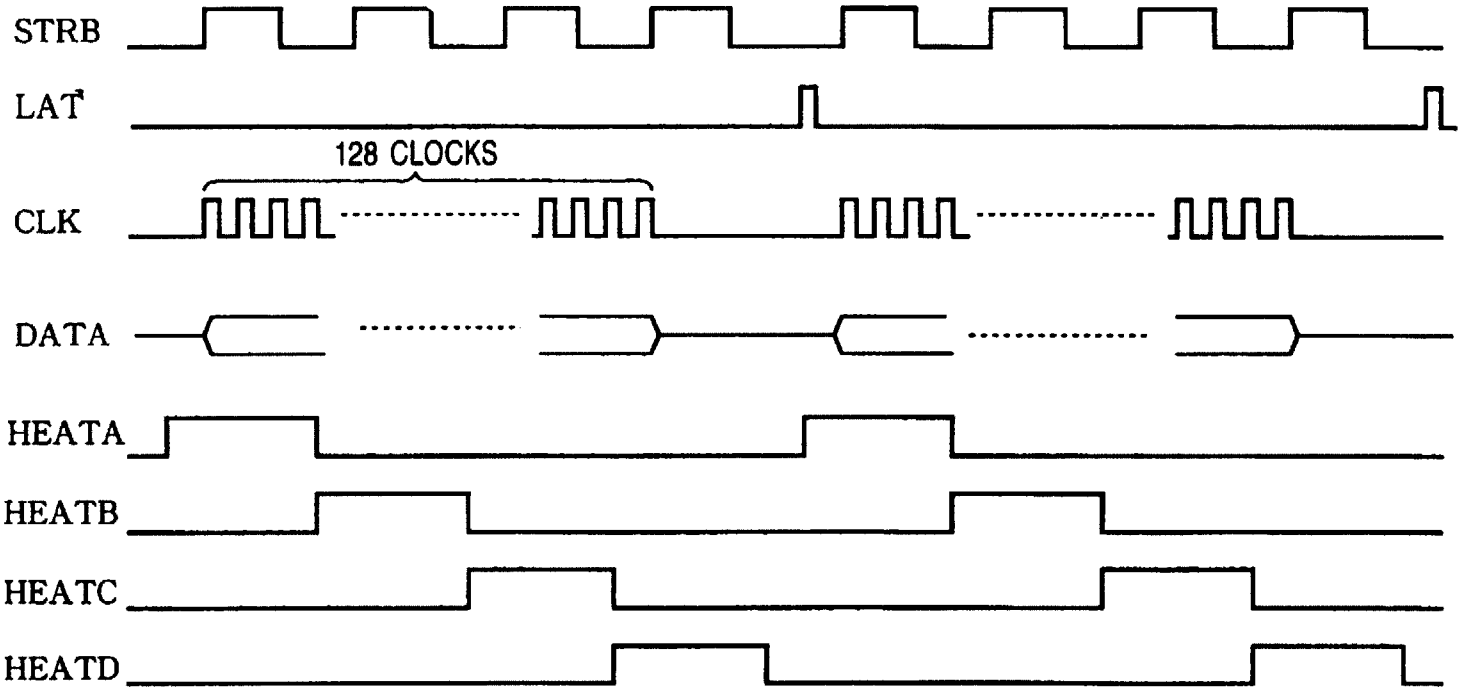
FIG. 10 PRIOR ART
FIG. 10 is a timing chart showing the driving sequence of the printing head shown in FIG. 9.

Therefore, according to this embodiment, when the four signals STRB, DATA, RESET, and CLK are input to the printing head, control for dividing the 128 heat-generating resistors into four blocks, and supplying an electric current to one of these blocks to drive it can be made on the basis of these signals. As can be seen from a comparison between the above-mentioned control circuit, and the conventional arrangement shown in FIG. 9, the conventional circuit requires 8 input signals, while this embodiment can reduce the number of input signals to 4. Therefore, a flexible print board for transmitting signals to the printing head can be thinned.

In addition, the decrease in the number of signal lines leads to improvement in reliability of the apparatus.

[Second Embodiment]

Figure 6:
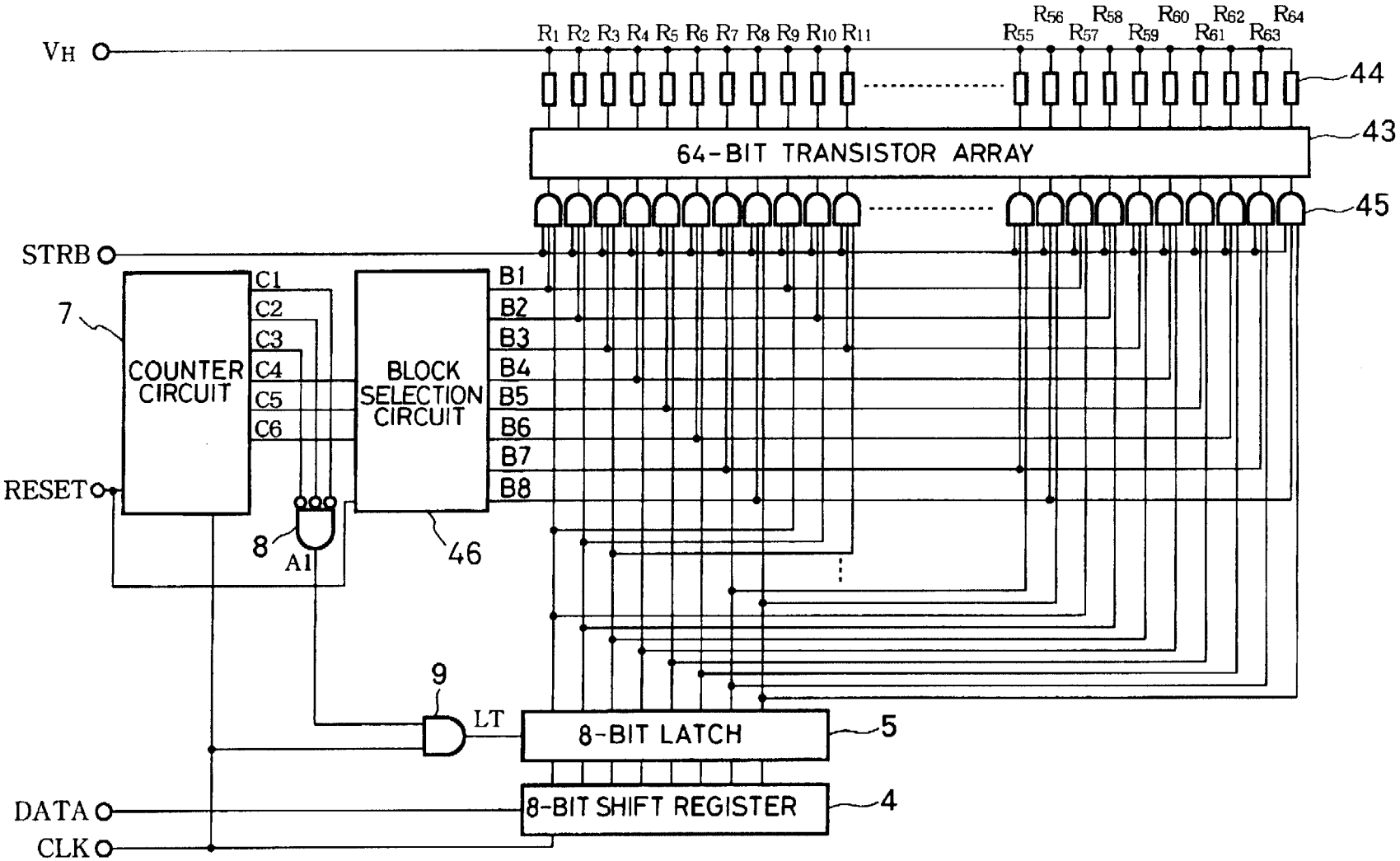
FIG. 6 is a block diagram showing the circuit arrangement of a printing head according to a second embodiment.
Figure 11:
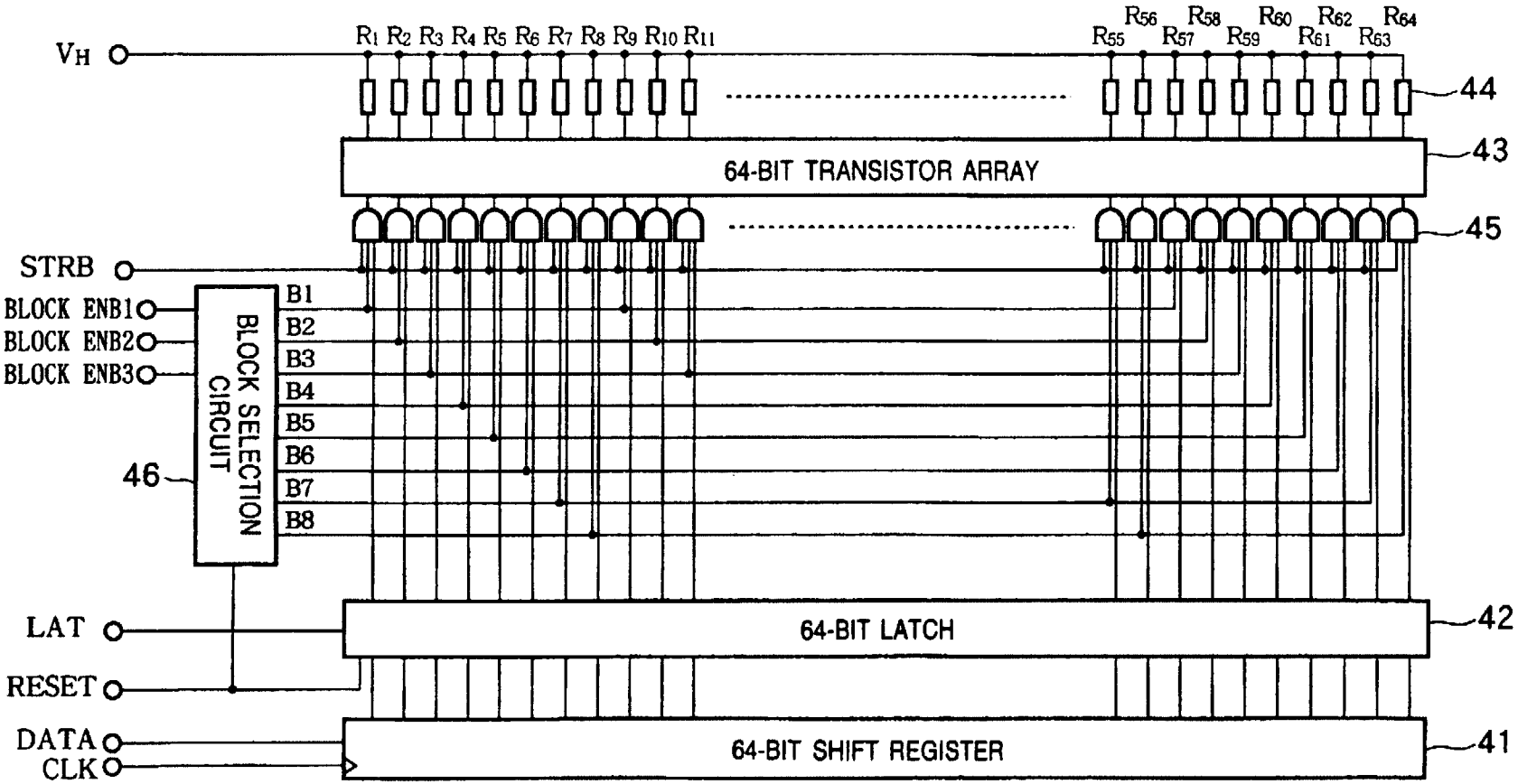
FIG. 11 PRIOR ART
FIG. 11 is a block diagram showing another circuit arrangement of a conventional printing head.
Figure 12:
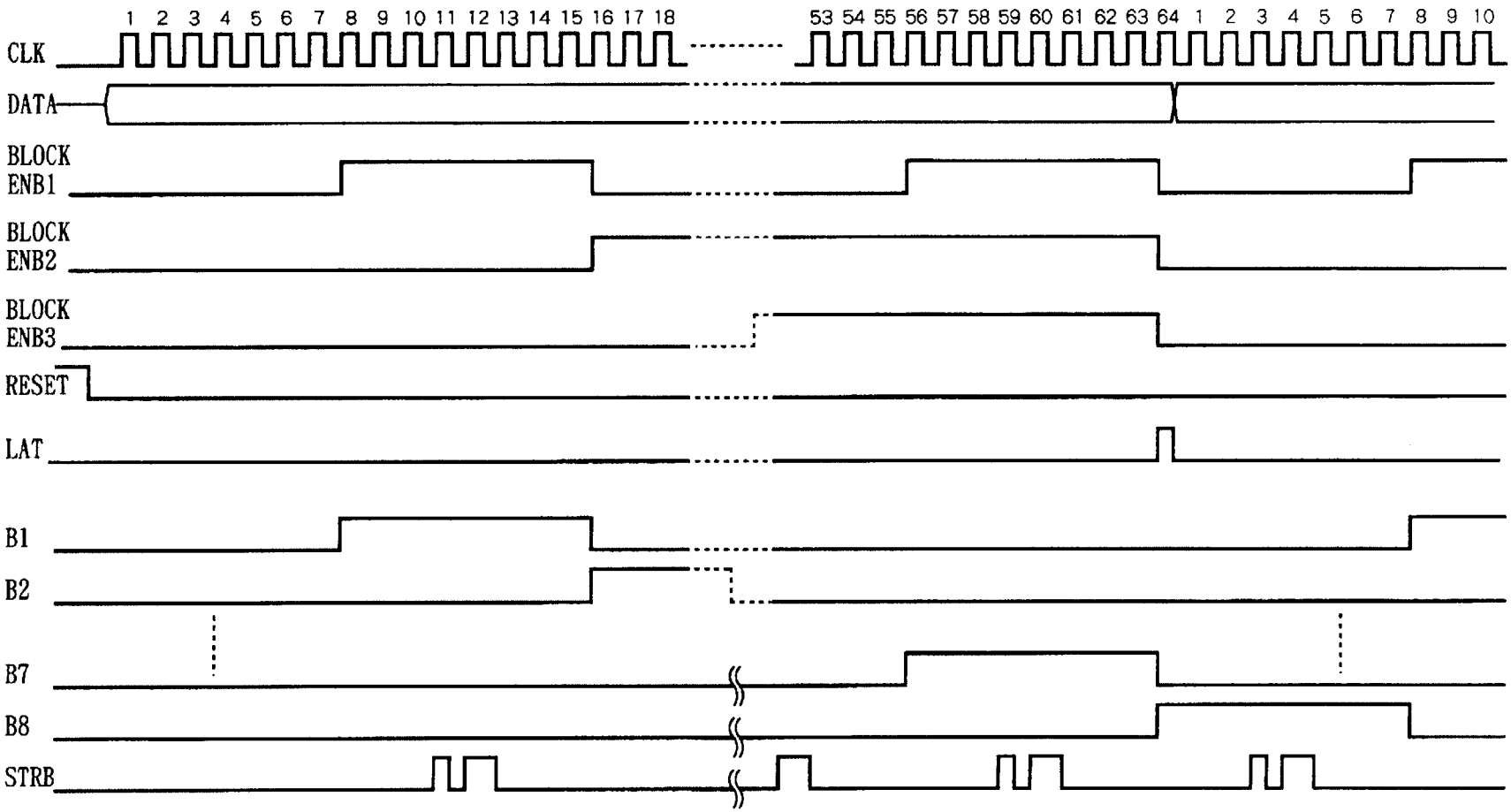
FIG. 12 is a timing chart showing the driving sequence of the printing head shown in FIG. 11.

FIG. 6 is a block diagram showing the circuit arrangement of the printing head IJH according to this embodiment. This circuit is arranged on a single circuit board, and this printing head can perform a printing operation for 64 pixels in the transfer direction of a printing medium in a single printing operation. Note that the signals input to the circuit of this embodiment are the same as those described in the first embodiment, and a repetitive description thereof will be avoided. The same reference numerals in FIG. 6 denote the same parts as in FIG. 11 of the prior art, and a detailed description thereof will be omitted.

Referring to FIG. 6, reference numeral 4 denotes an 8-bit shift register for inputting an image signal (DATA) in accordance with a clock signal (CLK); 5, an 8-bit latch circuit for latching the output from the 8-bit shift register 4; 7, a counter circuit for counting the clock signal (CLK); and 8 and 9, gate circuits.

FIG. 7 is a timing chart showing various signals input to the printing head IJH shown in FIG. 6. As shown in FIG. 6, the total number of clocks of the signal CLK during a single printing operation is "64", which is equal to the number of heat-generating elements. The 64 clocks are divided into 8 groups in units of 8 clocks.

The operation of the printing head of this embodiment will be described below with reference to the timing chart in FIG. 7.

When an image signal (DATA) is input to the 8-bit shift register 4 in accordance with a clock signal (CLK), the clock signal (CLK) is also input to the counter circuit 7, and the number of clocks of the signal CLK is counted, thus obtaining count outputs. Of these count outputs (C1, C2, C3, C4, C5, C6), the ON/OFF state of the output C1 is switched in synchronism with the period of the clock signal (CLK), the ON/OFF state of the output C2 is switched in synchronism with a period 2-fold that of the signal CLK, and similarly, the ON/OFF states of the outputs C3, C4, C5, and C6 are respectively switched in synchronism with periods 4-, 8, 16-, and 32-fold that of the signal CLK.

Of these outputs, the outputs C1, C2, and C3 are input to the gate circuit 8 to generate an internal control signal A1. The internal control signal A1 is input to the gate circuit 9 together with the signal CLK to generate another internal control signal LT. The signal LT is used as a latch signal for latching an 8-bit image signal. Furthermore, the outputs C4, C5, and C6 are input to a block selection circuit 46 to generate block selection signals (B1, B2, B3, B4, B5, B6, B7, B8).

More specifically, when 8-bit image data is input, the latch signal (LT) becomes "1" to latch the image signal, and the signal STRB generates a pulse signal shown in FIG. 4 while the block selection signal B1 is "1". At this time, the outputs from AND gates corresponding to heat-generating resistors R1, R9, . . . , R59 change to "1" to drive a 64-bit transistor array 43 corresponding to these heat-generating resistors, thereby heating the heat-generating resistors.

When an image signal (DATA) corresponding to the next 8-bit image data is input, a signal STRB is similarly applied while the block selection signal B2 is "1", and the 64-bit transistor array 43 is driven to heat heat-generating resistors R2, R10, . . . , R58.

Similarly, while the block selection signals B3, B4, . . . , B8 become "1" in turn, each eight heat-generating resistors are heated in units of 8-bit blocks.

Figure 8:
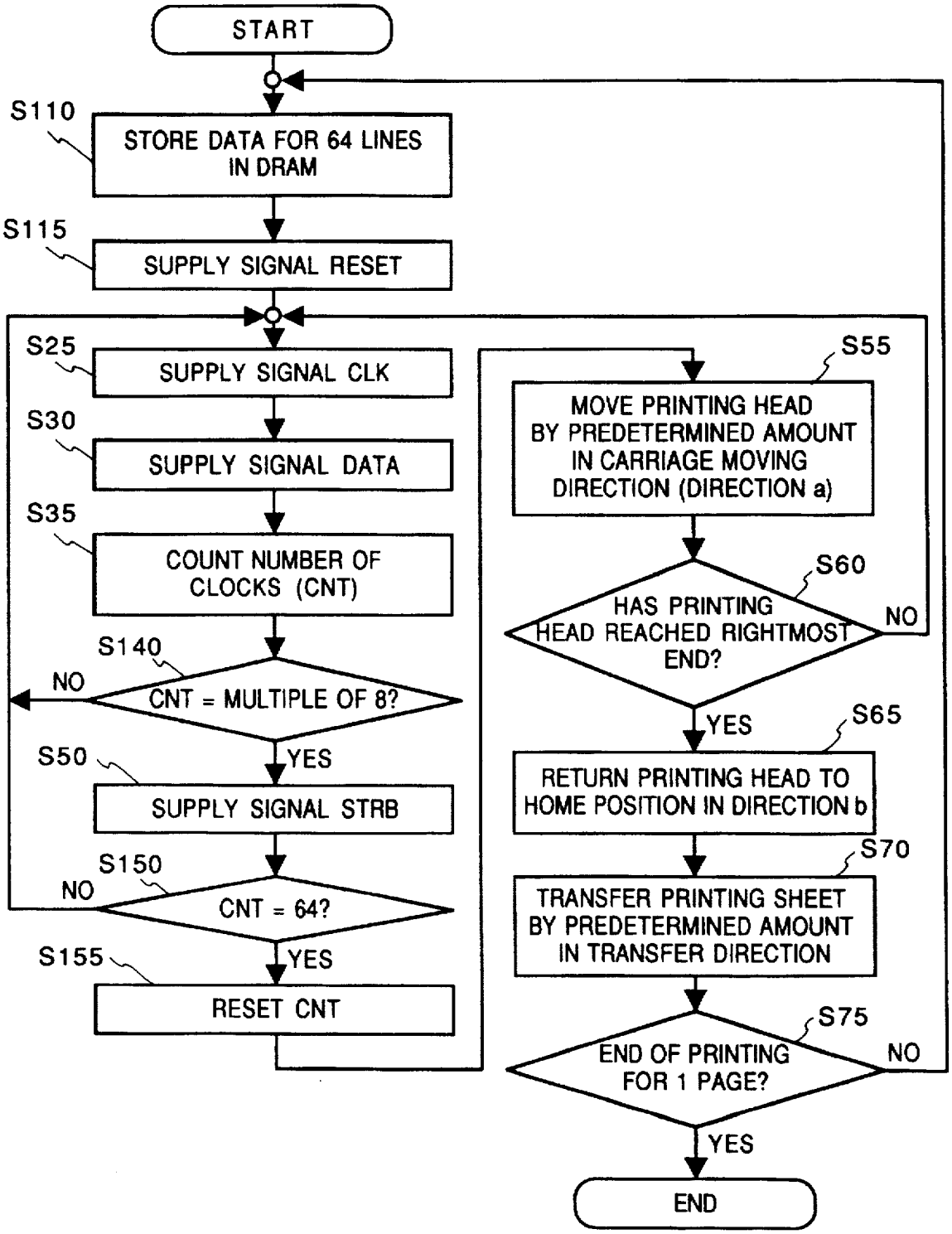
FIG. 8 is a flow chart showing the printing operation of a printer with the printing head shown in FIG. 6.

The printing operation of a printer with the printing head of this embodiment will be described below with reference to the flow chart shown in FIG. 8. Since the printing head of this embodiment can perform a printing operation for 64 pixels in the transfer direction of a printing medium in a single printing operation, the DRAM 1703 of a control unit stores image data for 64 lines accordingly. In addition, the same step numbers in FIG. 8 denote the same processing steps as in the flow chart of the printing operation according to the first embodiment shown in FIG. 5, and a detailed description thereof will be omitted. In the following description, only characteristic portions of this embodiment will be explained.

In step S110, the DRAM 1703 stores image data for 64 lines. This operation is attained when an information processing apparatus (not shown) such as a work station for supplying data to the printer transmits a predetermined command and its associated data, as in the first embodiment. In step S115, the signal RESET is supplied to the printing head IJH to reset the count value of the counter circuit 7.

In steps S25 to S35, the same processing as in the first embodiment is performed. It is then checked in step S140 if the number of clocks (value CNT) of the signal CLK is a multiple of 8. If YES in step S140, the flow advances to step S50; otherwise, the flow returns to step S25. After the signal STRB is supplied in step S50, it is then checked in step S150 if the value CNT is "64". If YES in step S150, the flow advances to step S155 to reset CNT; otherwise, the flow returns to step S25.

After the value CNT is reset, processing operations in steps S55 to S75 are executed in the same manner as in the first embodiment.

With this processing, the supply timings of the signals RESET and STRB to the printing head IJH can be controlled more easily than in the first embodiment.

Therefore, according to this embodiment, when the four signals STRB, DATA, RESET, and CLK are input to the printing head, control for dividing the 64 heat-generating resistors into eight blocks and sending an electric current to each of the blocks can be realized on the basis of these signals.

According to this embodiment, the latch signal is generated based on the signal CLK and the output from the counter circuit, and control for sending an electric current to the heat-generating resistors can be attained in accordance with the latch signal. For this reason, an image signal with the number of bits equal to the number of heat-generating resistors need neither be stored nor latched, and this embodiment is advantageous since the circuit can be constituted by a simple latch circuit and shift register, which store and latch an image signal with a smaller number of bits.

In each of the above two embodiments, the number of pixels (the number of bits) which can be printed in a single printing operation is exemplified as 128 or 64 bits, and the number of divided blocks of the heat-generating resistors is exemplified as 4 or 8 blocks. However, the present invention is not limited to these specific details, but printing heads with other numbers of pixels (numbers of bits) and other numbers of blocks may be used. However, in consideration of the efficient arrangement of the circuit, these values are preferably powers of 2 ($2^n$).

In each of the above two embodiments, the printing head mounted on the ink-jet printer is exemplified. However, the present invention is not limited to this, but may be applied to other printing methods, i.e., printers such as a thermal head printer, a wire-dot printer, and the like, which drive printing elements (heat-generating elements, and the like) by supplying a current.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type and continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only a cartridge type printing head, as described in the above embodiment, in which an ink tank is integrally arranged on the printing head itself but also an exchangeable chip type printing head which can be electrically connected to the apparatus main unit and can receive ink from the apparatus main unit upon being mounted on the apparatus main unit can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printing head, in which a plurality of printing elements are divided into a plurality of groups, including a plurality of transducers for driving the plurality of printing elements in each group unit, sending an electric current to each divided group of the plurality of transducers in accordance with printing data, and printing, comprising:

counter means for counting an input clock signal;

instruction signal generation means for generating an instruction signal which instructs to select one of the plurality of divided groups based on a count value output from said counter means;

latch means for latching an input image signal for a predetermined number of pixels; and electric current sending means for sending an electric current to the transducers corresponding to the selected group in accordance with the image signal latched by said latch means, and the instruction signal.

2. The printing head according to claim 1, wherein each of the plurality of printing elements comprises a heat-generating resistor.

3. The printing head according to claim 2, wherein each of the plurality of printing elements comprises a nozzle, for discharging ink corresponding to the heat-generating resistors.

4. The printing head according to claim 1, wherein said printing head comprises an ink-jet printing head for performing printing by discharging ink.

5. The printing head according to claim 1, wherein said printing head is a printing head for discharging ink by utilizing heat energy, and further comprises heat energy transducers for generating heat energy to be applied to the ink.

6. The printing head according to claim 1, further comprising:

latch signal generation means for generating a latch signal, which is used for latching the image signal for the predetermined number of pixels, based on the count value output from said counter means.

7. The printing head according to claim 1, further comprising:

holding means for temporarily holding the image signal for the predetermined number of pixels, and wherein the predetermined number of pixels is equal to the number of the plurality of printing elements.

8. The printing head according to claim 7, wherein said holding means comprises a shift register.

9. The printing head according to claim 1, further comprising:

holding means for temporarily holding the image signal for the predetermined number of pixels, and wherein the predetermined number of pixels is less than the number of the plurality of printing elements.

10. The printing head according to claim 9, wherein said holding means comprises a shift register.

11. The printing head according to claim 1, wherein said instruction signal generation means comprises a decoder for decoding the count value.

12. The printing head according to claim 1, wherein said instruction signal generation means comprises selection means for selecting one of the plurality of groups in accordance with the count value output from said counter means.

13. The printing head according to claim 1, wherein said transducers comprise transistors.

14. The printing head according to claim 1, wherein the number of the plurality of printing elements and the number of divided groups of the plurality of printing elements are powers of 2 ($2^n$).

15. The printing head according to claim 1, wherein said printing head comprises a thermal head type printing head.

16. A printer for printing an image on a printing medium by sending an electric current to a printing head in which a plurality of printing elements are divided into a plurality of groups, including a plurality of transducers for driving the plurality of printing elements in each group unit, sending an electric current to each divided group of the plurality of transducers in accordance with printing data, and printing, the printing head comprising counter means for counting an input clock signal, instruction signal generation means for generating an instruction signal which instructs to select one of the plurality of divided groups based on a count value output from said counter means, latch means for latching an input image signal for a predetermined number of pixels, and electric current sending means for sending an electric current to the transducers corresponding to the selected group in accordance with the image signal latched by said latch means, and the instruction signal, and driving the printing head, said printer comprising:

input means for inputting image data from an external unit;

storage means for temporarily storing the image data input by said input means;

transmission means for transmitting an image signal and a transmission clock for the image signal in accordance with the image data stored in said storage means;

first supply means for supplying a strobe signal for supplying an electric current to the printing head and driving the transducers of the printing head, to the printing head at a predetermined interval; and second supply means for supplying a reset signal to reset a count value of the counter means, included in the printing head, for counting the transmission clock.

17. The printer according to claim 16, further comprising:

first generation means for counting the transmission clock, and generating the strobe signal in accordance with the count value.

18. The printer according to claim 16, further comprising:

second generation means for counting the transmission clock, and generating the reset signal in accordance with the count value.

19. The printer according to claim 16, wherein the transducers comprise transistors.

20. A printing method of printing an image on a printing medium by sending an electric current to a printing head in which a plurality of printing elements are divided into a plurality of groups, including a plurality of transducers for driving the plurality of printing elements in each group unit, sending an electric current to each divided group of the plurality of transducers in accordance with printing data, and printing, the printing head comprising counter means for counting an input clock signal, instruction signal generation means for generating an instruction signal which instructs to select one of the plurality of divided groups based on a count value output from said counter means, latch means for latching an input image signal for a predetermined number of pixels, and electric current sending means for sending an electric current to the transducers corresponding to the selected group in accordance with the image signal latched by said latch means, and the instruction signal, and driving the printing head, said method comprising:

an input step of inputting image data from an external unit;

a storage step of temporarily storing the image data input in said input step in a storage medium;

a reset step of supplying a reset signal to reset a count value of the counter means, included in the printing head, for counting the transmission clock;

a transmission step of transmitting an image signal and a transmission clock for the image signal in accordance with the image data stored in the storage medium; and a supply step of supplying a strobe signal for supplying an electric current to the printing head and driving the transducers of the printing head, to the printing head at a predetermined interval.

21. A printing head comprising:

a plurality of printing elements;

driving means for dividing the plurality of printing elements into a plurality of groups, and driving the plurality of printing elements in unit of the group;

storage means for storing data, corresponding to the plurality of printing elements;

transfer means for transferring the data to said storage means in accordance with a predetermined clock signal;

count means for counting the predetermined clock signal; and selecting means for sequentially selecting each one of the plurality of groups to be driven by said driving means in accordance with the count value by said count means.

22. The printing head according to claim 21, wherein each of the plurality of printing elements comprises a heat-generating resistor.

23. The printing head according to claim 22, wherein each of the plurality of printing elements comprises a nozzle, for discharging ink, corresponding to the heat-generating resistor.

24. The printing head according to claim 21, further comprising latch signal generating means for generating a latch signal to input the data into said storage means in accordance with the count value by said count means.

25. A printing apparatus for printing an image on a printing medium with a printing head comprising a plurality of printing elements, driving means for dividing the plurality of printing elements into a plurality of groups, and driving the plurality of printing elements in unit of the group, storage means for storing data, corresponding to the plurality of printing elements, transfer means for transferring the data to said storage means in accordance with a predetermined clock signal, count means for counting the predetermined clock signal, and selecting means for sequentially selecting each one of the plurality of groups to be driven by said driving means in accordance with the count value by said count means, said apparatus comprising:

means for mounting the printing head; and supplying means for supplying a clock signal to the printing head.

26. The printing apparatus according to claim 25, wherein each of the plurality of printing elements in the printing head comprises a heat-generating resistor.

27. The printing apparatus according to claim 26, wherein each of the plurality of printing elements comprises a nozzle, for discharging ink, corresponding to the heat-generating resistor.

28. The printing apparatus according to claim 25, wherein the printing head further comprises latch signal generating means for generating a latch signal to input the data into said storage means in accordance with the count value by said count means.

29. The printing apparatus according to claim 25, further comprising conveyance means for conveying the printing medium.

* * * * *